US007056359B1

(12) United States Patent
Somerville et al.

(10) Patent No.: US 7,056,359 B1
(45) Date of Patent: Jun. 6, 2006

(54) PROCESS FOR MODIFYING COAL SO AS TO REDUCE SULFUR EMISSIONS

(76) Inventors: Robin B. Somerville, 2517 Ninth St., Port Neches, TX (US) 77651; Liang-Tseng Fan, 830 Lee St., Manhattan, KS (US) 66502

( * ) Notice: Subject to any disclaimer, the term of this patent is extended or adjusted under 35 U.S.C. 154(b) by 0 days.

(21) Appl. No.: 10/089,896

(22) PCT Filed: Oct. 4, 2000

(86) PCT No.: PCT/US00/27357

§ 371 (c)(1),
(2), (4) Date: Jul. 16, 2002

(87) PCT Pub. No.: WO01/25373

PCT Pub. Date: Apr. 12, 2001

Related U.S. Application Data

(60) Provisional application No. 60/157,657, filed on Oct. 5, 1999.

(51) Int. Cl.
*C10L 5/00* (2006.01)

(52) U.S. Cl. ..... 44/604; 44/503; 44/504; 44/622

(58) Field of Classification Search ..... 44/604, 44/503, 504
See application file for complete search history.

(56) References Cited

U.S. PATENT DOCUMENTS 4,226,601 A * 10/1980 Smith ..... 431/12
4,522,626 A * 6/1985 Espenscheid ..... 44/604
4,824,441 A * 4/1989 Kindig ..... 44/604

* cited by examiner

*Primary Examiner*—Ellen M. McAvoy
(74) *Attorney, Agent, or Firm*—Egbert Law Offices

(57) ABSTRACT

A method of manufacturing a coal product having reduced sulfur emissions including the steps of grinding coal into a powder form having a desired particle size; blending the ground coal with hydrated lime; adding water to the blend so as to have a moisture content of between 10 and 30 weight percent and drying the water-added blend so as to have a desired reduced moisture content. The desired reduced moisture content is less than 1% of the total weight of the coal powder and the hydrated lime. The step of drying includes heating the water-added blend to a temperature of between 300 and 400° F. in an externally heated oven. Waste heat form a power plant can be used so as to head the blend.

16 Claims, 1 Drawing Sheet

PROCESS FOR MODIFYING COAL SO AS TO REDUCE SULFUR EMISSIONS

This application is a 371 of PCT/US00/27357, filed 4 Oct. 2000, which claims priority from Provisional Application 60/157,657; filed 5 Oct. 1999.

TECHNICAL FIELD

The present invention relates to coal desulfurization. More particularly, the present invention relates to methods and processes by which the resultant emissions of sulfur from coal burning operations are reduced. The present invention also relates to the manufacture of coal treated with fresh hydrated lime.

BACKGROUND ART

Electric-power plants fired by coal or oil emit sulfur oxides, nitrogen oxides, and particulates. In industrialized countries, such plants account for up to 75% of the total of sulfur oxides, and, since the electric-power industry is rapidly proliferating, the potential increase of sulfur-oxide emissions is tremendous.

A number of measures have been adopted in an effort to control sulfur-oxide pollution. However, a number of technical problems stand in the way. In many existing power plants, low-sulfur coal cannot be burned without operational difficulties or without incurring high capital costs for furnace modifications. Sulfur can be removed from coal before burning, but the procedure is costly. The content can be cut in half by pulverizing the coal to the consistency of talcum powder and removing the pyrites (sulfur compounds) or by one-third by washing the coal and removing noncarbonaceous material. However, even with as much as 70% of the sulfur removed, the final coal product might still be classified as a high-sulfur fuel.

Several methods of removing sulfur from stack gases have been considered and utilized. In one technique, pulverized limestone or dolomite is added to the boiler charge, creating oxides that react with the sulfur oxides to form solid sulfite and sulfate particles that can be removed by electrostatic precipitation. In another process, catalytic conversion, the sulfur dioxide is converted to sulfur trioxide, which combines with water in the stack gas to form a sulfuric acid mist that can be trapped and eliminated. Another method is to produce sulfuric acid, which can be readily removed from the stack gas by the addition of an activated char, a carbonaceous material.

In most uses, the sulfur content of coal is objectionable in varying degrees. Part of the sulfur is associated with ash, and coal washing removes some sulfur along with the ash. Much sulfur, however, is more intimately associated with the coal substance itself and cannot be removed by washing. Since carbonization removes some sulfur, coke usually contains a lower percentage of sulfur than the coal from which it is made. During total gasification, most of the sulfur is converted into hydrogen sulfide, the form in which it can be readily separated from the gas. Extraction of coal with solvents produces an extract of relatively low sulfur content. Despite the use of these methods and considerable effort, no effective method has been devised to reduce the sulfur content substantially, particularly the portion closely associated with the coal substance.

It is an object of the present invention to reduce sulfur emissions from the combustion of high-sulfur coal.

It is a further object of the present invention to provide a process that reduces the ash from the combusted coal.

It is a further object of the present invention to provide a process that lowers the pH of the ash of the combusted coal.

It is still a further object of the present invention to provide a process for reducing sulfur emissions in an economic, efficient and easy-to-use operation.

These and other objects and advantages of the present invention will become apparent from a reading of the attached specification.

SUMMARY OF THE INVENTION

The present invention is a process for manufacturing modified coal so as to reduce sulfur emissions. This process comprises the steps of: (1) grinding the coal to a powder of a desired consistency and particle size; (2) blending the ground coal with fresh hydrated lime [$Ca(OH)_2$]; (3) adding water to the blended coal/hydrated lime mixture so as to maintain a moisture content of between 10 and 30% of the overall weight; and (4) drying the agglomerated coal/hydrated lime mixture so as to have a moisture content of a desired level.

In the process of the present invention, the coal is ground to a size of between 80 and 20 meshes (180 micrometers to 850 micrometers). Ideally, the average size of the ground coal particle will be 40 meshes (425 micrometers). Within the concept of the present invention, the coal which is ground is a high-sulfur coal. The fresh hydrated lime is in a powder form. Ideally, the particles of the powder form of the hydrated lime should be less than 10% of the size of the coal particles. The amount of hydrated lime which is added to the ground coal particles will depend upon the sulfur content of the coal. Generally, the amount of fresh hydrated lime will be 1 to 15% of the weight of the coal.

Water is added to the blended mixture of the hydrated lime and ground coal so as to achieve an intimate agglomeration. Finally, the agglomeration is dried so that the moisture content is approximately 1%. The drying can be accomplished by using externally heated dryers or ovens. The mixture of the water, hydrated lime, and ground coal is heated to a temperature of between 300 and 400° F. The heat for such dryers can be provided by the waste heat of a power plant. The heat can also be provided by a preheater prior to passing the treated coal to the boiler.

DETAILED DESCRIPTION OF THE INVENTION

Figure 1:
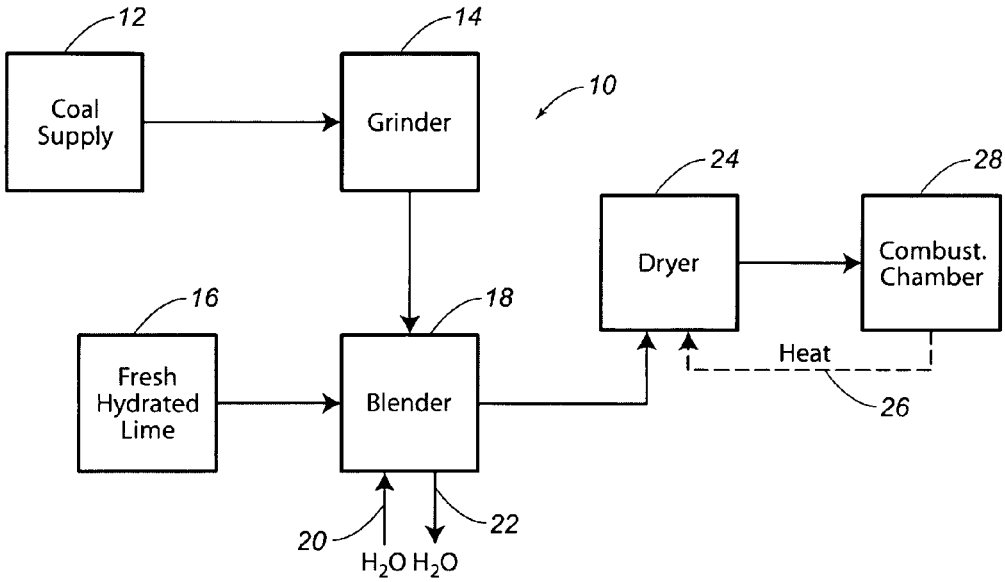
FIG. 1 is a schematic illustration of the process of the present invention.

Referring to FIG. 1, there is shown at 10 a schematic representation of the process of the present invention. In the present invention, a coal supply 12 is available for the delivery of coal to a grinder 14. The coal supply 12 can be of a high-sulfur coal. The grinder receives the high-sulfur coal from coal supply 12 and serves to grind the coal so as to reduce the size of the coal particles to an average sieve size in the range of between 20 meshes ($850\times10^{-6}$m or 850 m) and 80 meshes ($180\times10^{-6}$m or 180 m). The preferred size of the coal particles will be an average of 40 meshes ($425\times10^{-6}$m or 425 m).

Initially, a supply 16 of fresh hydrated lime [$Ca(OH)_2$] is provided in powder form. The actual powder form of the fresh hydrated lime in the supply 16 is of a size which is less than 10% of the size of the coal particles from the grinder 14. The fresh hydrated lime will pass to a blender 18 along with the coal particles from the grinder 14. The fine particles of coal from the grinder 14 are thoroughly blended with a predetermined amount of the fresh hydrated lime. The amount of the hydrated lime [$Ca(OH)_2$] to be added to the ground coal will depend upon the content, nature and distribution of sulfur in the coal. The amount of hydrated lime should range from between 1 to 15% of the weight of the coal. The preferred amount of hydrated lime which is added to the ground coal will be approximately 5% to 6% when the sulfur content of the coal is about 3%.

As can be seen in FIG. 1, inlet 20 is provided so as to introduce water into the blender 18. An outlet 22 is provided so as to remove water from the blender 18. In order to allow for the intimate agglomeration between the particles of coal and the particles of hydrated lime to occur, the moisture content of the mixture must be maintained at an appropriate level. Accordingly, water is either added to or removed from the mixture in the blender 18 depending upon the moisture content of the coal. The moisture level of the resultant blended mixture should be within the range of between 10 and 30% on the basis of the overall weight. The preferred moisture level of the resultant mixture is approximately 25%. For example, the moisture content of the fresh coal may range from a minimum of 15% to as high as 30% based upon the weight of the coal. If dried coal is used, then the moisture content may be as low as 1%. On the other hand, when the moisture content is below 10%, then it would be necessary to add water to the blender 18. As such, the inlet 20 and the outlet 22 are provided so as to add or remove water, respectively, as required relative to the moisture content of the coal.

The particles of hydrated lime [$Ca(OH)_2$] distribute themselves among the coal particles through thorough mixing. However, because of their bonding characteristics, they adhere firmly to the coal particles. The average size of the resultant particles is 10 to 20% greater than that of the coal particles.

The agglomerated particles are then passed from the blender 18 to the dryer 24. In the dryer, the coal/hydrated lime mixture is dried so as to have a final moisture content of approximately 1%. The dryer 24 is an externally heated dryer or oven which acts on the coal/hydrated lime mixture with a temperature of between 300 and 400° F. The preferred temperature is 350° F. Any source of heat can be provided to the dryer 24 so as to accomplish the drying of the coal. For example, one source of heat for the drying can be surplus or waste heat from a power plant. The broken line 26 illustrates how this waste heat can be passed to the dryer 24 from the power plant. Another method of drying is to utilize the dryer 24 in a preheater with the same source of surplus or waste heat prior to the injection of the coal/hydrated lime mixture into the combustion chamber 28. By recirculating the heat from the combustion chamber or from the boiler of the power plant, a great deal of savings in the cost of energy and facilities for the drying of the coal/hydrated lime mixture can be achieved.

The following test results show the improvement in sulfur emission through the use of the process of the present invention:

A. Composition and Heating Value of the Original Sample (Illinois Coal: Sample No. 1 BC-110)

| Component | Wt % |
|---|---|
| Moisture | 10.6 |
| Volatile Matter | 39.5 |
| Fixed C | 50.8 |
| H-T Ash | 9.7 |
| Carbon | 71.3 |
| Hydrogen | 5.2 |
| Nitrogen | 1.4 |
| Sulfatic Sulfur | 0.1 |
| Pyritic Sulfur | 2.1 |
| Organic Sulfur | 2.4 |
| Total Sulfur | 4.6 |
| Total Chlorine | 0.0 |
| High Heating Value (HHV) (Moisture Free Basis) | 13,077 Btu/lb |

B. Reduction in Sulfur Emission and High Heating Value (HHV) Treated Coal (SULFACOAL)

| Content of Reagent (wt %) | HHV, Moisture Free Basis (Btu/lb) | Estimated Reduction in Sulfur Emission (%) |
|---|---|---|
| 5 | 12094 | ca. 80% or more |
| 7 | 11896 | ca. 85% or more |

As can be seen from these test results, the process of the present invention treats high-sulfur coal with the fresh hydrated lime [$Ca(OH)_2$] so that sulfur emission from the combustion of the coal can be reduced by up to 90%. Combustion of the treated coal generates less ash than that of untreated coal with sulfur-removal by a conventional lime (CaO) scrubbing system. The characteristics of the product of the process of the present invention are attributable to the fact that the fresh hydrated lime, yet to be exposed to carbon dioxide ($CO_2$) in the atmosphere to any appreciable extent, is far more reactive with sulfur in coal than unhydrated lime (CaO). Moreover, the ash of the treated coal of the process of the present invention has a lower pH than ash from conventional combustion and is of good quality. As a result, it makes the ash ideal for marketing rather than disposal.

The process of the present invention uses waste heat of the power plant and can be operated by current operators. Thus, these operators can maintain their own quality control on the fuel source with no change in coal supply or contractors. The process is not affected by extreme winter conditions and is suitable for direct feed to the boilers, thereby circumventing the necessity of preheating. By using waste heat, the process of the present invention conserves valuable resources and reduces the impact on the environment.

According to the test results utilizing the process of the present invention, the process of the present invention only marginally reduces the heating value or BTU's of the treated coal. However, the results indicate that emissions fall well below U.S. E.P.A. limits. Consequently, this decreases the requirement for expensive, sulfur-scubbing equipment. Furthermore, a power plant supplied with the treated coal of the present invention requires much smaller amounts of scrubbing agents than an equivalent conventional power plant with sulfur scrubbing facilities. As a result, there is a savings on the costs of bulk handling, storage and transportation.

In addition to the substantial reduction in costs and in sulfur emissions, the treated coal of the present invention has two other noteworthy benefits. First, there is a decrease in $NO_x$ generation. Second, there is also a capture of heavy metals in the ash through the formation of metallic hydroxides with low solubilities. Moreover, the amount of ash from a power plant supplied with the treated coal of the present invention is an order of magnitude less than the amount of ash produced from an equivalent power plant utilizing lime injection.

The foregoing disclosure and description of the invention is illustrative and explanatory thereof. Various changes in the details of the illustrated process can be made within the scope of the present invention without departing from the true spirit of the invention.

We claim:

1. A method of utilizing a coal product having reduced sulfur emissions comprising:

grinding a raw coal material into a coal powder having a desired particle size;

blending said coal powder with fresh hydrated lime having a moisture of no more than 5% by weight in a vessel so as to spontaneously form pellets of coal and fresh hydrated lime, said fresh hydrated lime being generally unexposed to atmospheric carbon dioxide;

adding water to the pellets of coal powder and fresh hydrated lime in the vessel so as to have a moisture content of between 10 and 30 weight percent of the total weight of the water-added pellets;

drying the water-added pellets so as to have a desired moisture content; and injecting the dried pellets into a combustion chamber.

2. The method of claim 1, said coal powder having a particle size of between 80 and 20 meshes.

3. The method of claim 2, said coal powder having an average particle size of 40 meshes.

4. The method of claim 1, said fresh hydrated lime being of a particle form.

5. The method of claim 4, said particle form of said fresh hydrated lime having an average size of less than 10 percent of said desired particle size of said coal powder.

6. The method of claim 1, said step of blending comprising:

blending said fresh hydrated lime with said coal powder in which said fresh hydrated lime is 1 to 15 weight percent of the weight of said coal powder.

7. The method of claim 1, said step of adding water comprising:

immediately adding water to the pellets such that the pellets become an intimately mingled mixture of said coal powder and said fresh hydrated lime.

8. The method of claim 1, said desired moisture content being less than 1 weight percent.

9. The method of claim 1, said step of drying comprising:

passing the water-added pellets from said vessel to an externally heated oven without exposing the water-added pellets to carbon dioxide.

10. The method of claim 9, said step of drying further comprising:

heating the water-added pellets to a temperature of between 300 and 400° F.

11. The method of claim 10, said step of heating comprising:

heating the water-added blend from waste heat from said combustion chamber.

12. The method of claim 9, said step of drying further comprising:

preheating the water-added pellets prior to passing the water-added pellets into said externally heated oven.

13. The method of claim 1, the raw coal material having a sulfur content of approximately 3% of a total weight of the raw coal material, said fresh hydrated lime being between 5 to 6 weight percent of the total weight of the raw coal material.

14. A method of manufacturing a coal product having reduced sulfur emissions comprising:

grinding coal into a powder having a particle size of between 80 and 20 meshes;

blending the coal powder with fresh hydrated lime with a moisture content of 5% or less in which the fresh hydrated lime is between 1 to 15 weight percent of the weight of the powder, said fresh hydrated lime being unexposed to carbon dioxide;

adding water to the pellets so that the pellets have a moisture content of between 10 and 30 weight percent of the total weight of the pellets, said powder and said fresh hydrated lime and said water being in a container; and heating the water-added pellets to a temperature of between 300 and 400° F. in said enclosed container so as to dry the pellets to a moisture content of less than 1 weight percent, said steps of grinding and blending spontaneously forming the pellets and adding the water and heating being in a continuous process.

15. The method of claim 14, said coal having a sulfur content of no less than 3 weight percent of the total weight of the coal.

16. The method of claim 14, said fresh hydrated lime being between 5 to 6 weight percent of the total weight of the powder.

* * * * *